US010020139B2

(12) United States Patent
Lee et al.

(10) Patent No.: US 10,020,139 B2
(45) Date of Patent: Jul. 10, 2018

(54) KEY STRUCTURE

(71) Applicant: PRIMAX ELECTRONICS LTD., Taipei (TW)

(72) Inventors: Yi-Shu Lee, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/397,495

(22) Filed: Jan. 3, 2017

(65) Prior Publication Data

US 2018/0144885 A1 May 24, 2018

(30) Foreign Application Priority Data

Nov. 18, 2016 (TW) ..... 105137890 A

(51) Int. Cl.
*H01H 13/52* (2006.01)
*H01H 13/7065* (2006.01)
*H01H 13/83* (2006.01)

(52) U.S. Cl.
CPC ..... *H01H 13/7065* (2013.01); *H01H 13/52* (2013.01); *H01H 13/83* (2013.01); *H01H 2215/008* (2013.01); *H01H 2219/036* (2013.01)

(58) Field of Classification Search
CPC .... H01H 13/14; H01H 3/125; H01H 13/7065; H01H 3/12; H01H 13/52; H01H 13/70; H01H 13/83; H01H 2219/062; H01H 13/023; H01H 2219/036; H01H 2219/044; H01H 9/161
USPC ..... 200/310–314, 341–345, 5 A
See application file for complete search history.

(56) References Cited

U.S. PATENT DOCUMENTS

2004/0256203 A1* 12/2004 Pihlaja ..... H01H 13/7013 200/5 A
2011/0006930 A1* 1/2011 Laurent ..... H01H 13/702 341/34
2011/0290628 A1* 12/2011 Tsai ..... H01H 3/125 200/5 A
2012/0070218 A1* 3/2012 Cheng ..... G06F 3/0202 400/472
2014/0190804 A1* 7/2014 Zhang ..... H01H 13/83 200/314

* cited by examiner

*Primary Examiner* — Edwin A. Leon
*Assistant Examiner* — Ahmed Saeed
(74) *Attorney, Agent, or Firm* — Kirton McConkie; Evan R. Witt

(57) ABSTRACT

A key structure includes a base plate, an illumination module, a switch circuit board, a metallic elastic element, a supporting element, a metallic pressing plate and a covering member. The metallic elastic element is disposed on the switch circuit board. The supporting element is located beside the metallic elastic element. An edge of the metallic pressing plate is fixed on the supporting element. As the metallic pressing plate is swung relative to the base plate to push the metallic elastic element, the switch circuit board is triggered by the metallic elastic element. The covering member covers the base plate and the metallic pressing plate. The covering member has a light-transmissible region. A light beam from the illumination module passes through the light-transmissible region. Consequently, the key structure is illuminated.

9 Claims, 3 Drawing Sheets

KEY STRUCTURE

FIELD OF THE INVENTION

The present invention relates to a key structure, and more particularly to a slim-type key structure.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is pressed, the rubbery elastomer 13 is subjected to deformation to push the corresponding key intersection of the membrane switch circuit member 14. Consequently, the corresponding key signal is generated.

The operations of the conventional key structure 1 in response to the pressing action of the user will be illustrated as follows. Please refer to FIG. 1 again. When the keycap 11 is pressed, the keycap 11 is moved downwardly to push the scissors-type connecting element 12 in response to the pressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer pressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not pressed. The structures and the operations of the conventional key structure have been mentioned as above.

With increasing development of science and technology, the demand on a slim-type keyboard is gradually increased. Consequently, the manufacturers of keyboard make efforts in developing slimmer key structures. However, since the scissors-type connecting element for connecting the keycap and the base plate is essential, the reduction of the thickness of the key structure is still unsatisfied. Moreover, since the thickness of the key structure is decreased, the structural strength of the key structure is reduced and the key structure is readily damaged.

Therefore, there is a need of providing a key structure with slimness and enhanced structural strength.

SUMMARY OF THE INVENTION

The present invention provides a key structure with slimness and enhanced structural strength.

In accordance with an aspect of the present invention, there is provided a key structure. The key structure includes a base plate, an illumination module, a switch circuit board, a metallic elastic element, a supporting element, a metallic pressing plate and a covering member. The illumination module is disposed on the base plate, and emits a light beam. The switch circuit board is disposed on the illumination module. When the switch circuit board is triggered, a key signal is generated. The metallic elastic element is disposed on the switch circuit board. The metallic elastic element is subjected to deformation to trigger the switch circuit board when the metallic elastic element is pressed, or the metallic elastic element provides an elastic force. The supporting element is disposed on the switch circuit board, and located beside the metallic elastic element. An edge of the metallic pressing plate is fixed on the supporting element. The metallic pressing plate is swung relative to the base plate to push the metallic elastic element in response to an external force. Moreover, the metallic pressing plate has an opening. The covering member covers the base plate, the illumination module, the switch circuit board, the metallic elastic element, the supporting element and the metallic pressing plate. The covering member has a light-transmissible region corresponding to the opening. The light beam passes through the switch circuit board, the opening and the light-transmissible region sequentially. Consequently, the key structure is illuminated.

From the above descriptions, the present invention provides a key structure. The key structure of the present invention is equipped with a supporting element and a metallic pressing plate to replace the keycap and the scissors-type connecting element of the conventional key structure. Moreover, the key structure of the present invention is equipped with a metallic elastic element to replace the rubbery elastomer of the conventional key structure. Since the overall thickness of the supporting element and the metallic pressing plate is much smaller than the overall thickness of the keycap and the scissors-type connecting element, the key structure of the present invention is thinner than the conventional key structure. That is, the thickness of the key structure of the present invention is largely reduced when compared with the conventional key structure. Moreover, since the metallic pressing plate of the key structure of the present invention is made of the metallic material, the structural strength of the metallic pressing plate is larger than the conventional key structure that is made of the plastic material. In addition, the metallic pressing plate is not readily damaged. Moreover, the key structure of the present invention further comprises an illumination module under the metallic pressing plate for emitting a light beam. Moreover, the main body of the metallic pressing plate has an opening for allowing the light beam to pass through. Consequently, the key structure has the luminous efficacy.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with enhanced structural strength and slim appearance.

Figure 1:
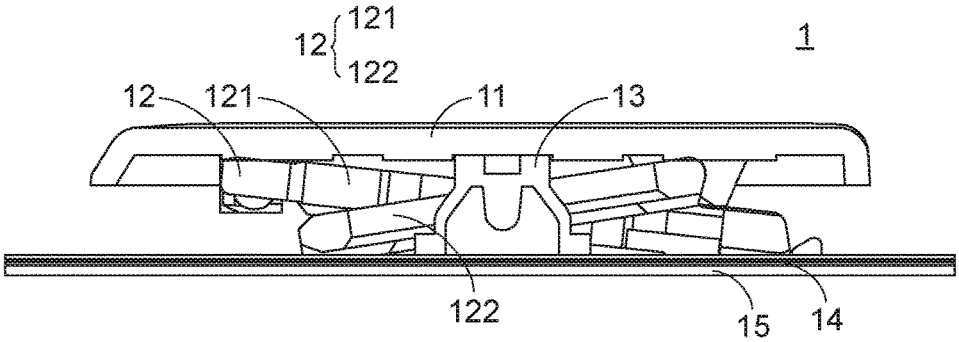
FIG.1 PRIOR ART
FIG. 1 is a schematic side cross-sectional view illustrating a conventional key structure.
Figure 2:
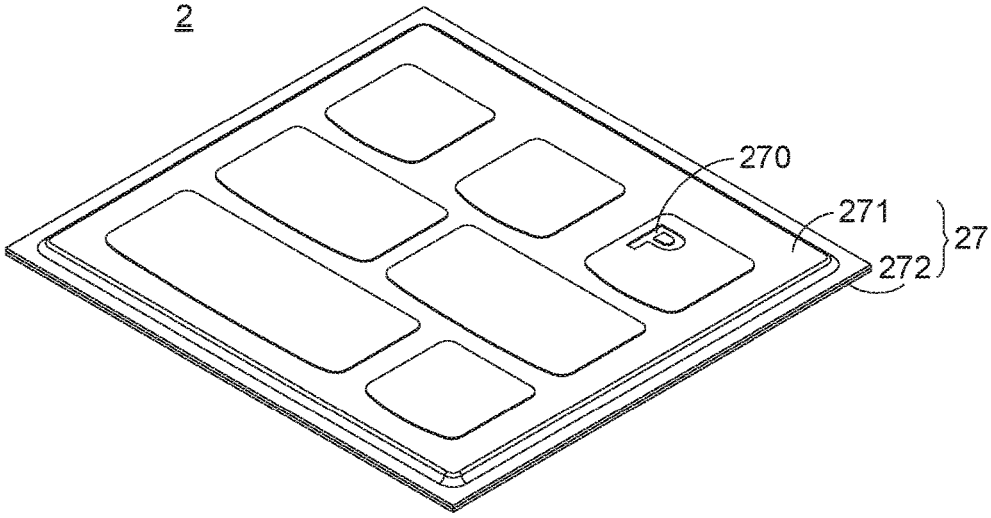
FIG. 2 is a schematic perspective view illustrating a keyboard with key structures according to an embodiment of the present invention.
Figure 3:
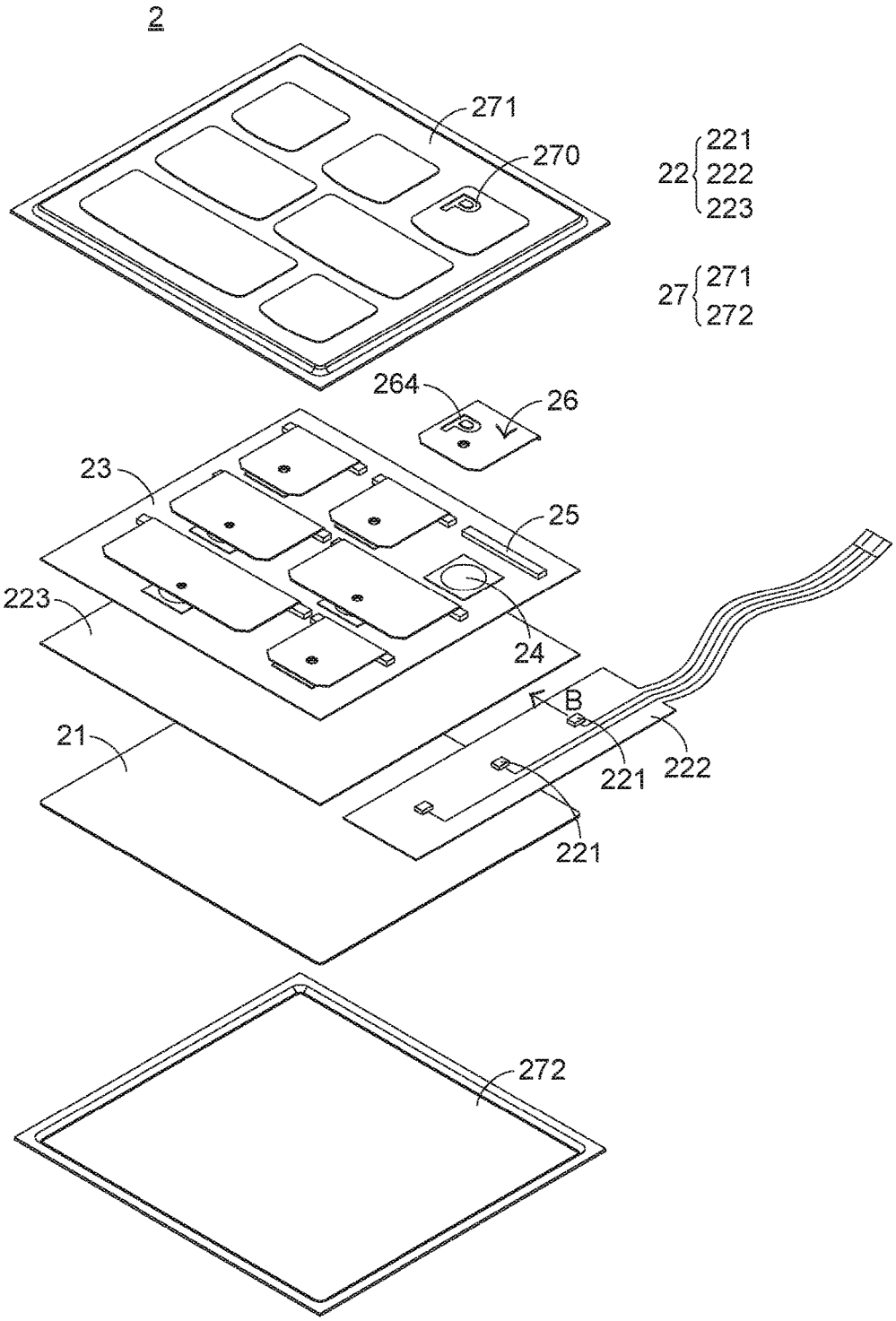
FIG. 3 is a schematic exploded view illustrating the keyboard with the key structure according to the embodiment of the present invention.

FIG. 2 is a schematic perspective view illustrating a keyboard with key structures according to an embodiment of the present invention. FIG. 3 is a schematic exploded view illustrating the keyboard with the key structure according to the embodiment of the present invention. As shown in FIG. 2, the keyboard comprises plural key structures 2. The key structure 2 comprises a base plate 21, an illumination module 22, a switch circuit board 23, a metallic elastic element 24, a supporting element 25, a metallic pressing plate 26 and a covering member 27. The illumination module 22 is disposed on the base plate 21 for emitting a light beam B. The switch circuit board 23 is disposed on the illumination module 22. Moreover, the switch circuit board 23 comprises plural key intersections (not shown) corresponding to the metallic elastic element 24. When one of the key intersections is pressed and triggered, a corresponding key signal is generated. The metallic elastic element 24 is disposed on a top surface of the switch circuit board 23 and aligned with the key intersection. When the metallic elastic element 24 is pressed by the metallic pressing plate 26, the metallic elastic element 24 is subjected to deformation to trigger the key intersection of the switch circuit board 23. When the metallic elastic element 24 is restored from a deformed state to an original shape, the metallic elastic element 24 provides an elastic force to the metallic pressing plate 26. In an embodiment, the metallic elastic element 24 is an elastic sheet that is made of a metallic material. For example, the metallic elastic element 24 is a metal dome. Moreover, the switch circuit board 23 is a membrane switch circuit board.

Figure 4:
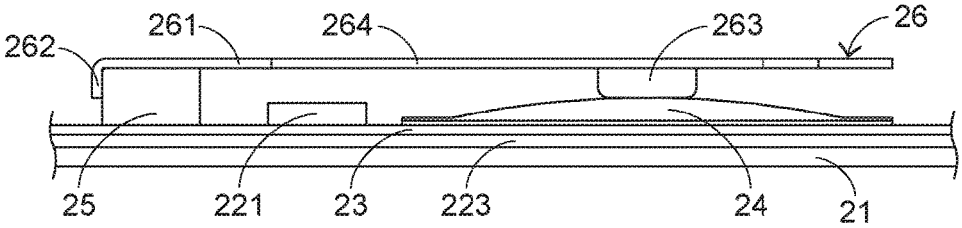
FIG. 4 is a schematic side view illustrating the key structure according to an embodiment of the present invention.

FIG. 4 is a schematic side view illustrating the key structure according to an embodiment of the present invention. Please refer to FIGS. 3 and 4. The supporting element 25 is disposed on the switch circuit board 23 and located beside the metallic elastic element 24. An edge of the metallic pressing plate 26 is fixed on the supporting element 25. Consequently, in response to an external force, the metallic pressing plate 26 is swung relative to the base plate 21. As the metallic pressing plate 26 is swung, the metallic elastic element 24 is pushed by the metallic pressing plate 26. In an embodiment, the metallic pressing plate 26 comprises a main body 261, a fixing part 262, a triggering part 263 and an opening 264. The main body 261 is swung relative to the base plate 21. The fixing part 262 is located at the edge of the metallic pressing plate 26 and connected with the main body 261. Consequently, the fixing part 262 is a bent structure relative to the main body 261. An edge of the main body 261 of the metallic pressing plate 26 is fixed on the supporting element 25 through the fixing part 262. The triggering part 263 is disposed on a bottom surface of the main body 261. Moreover, the triggering part 263 is contacted with the metallic elastic element 24. The opening 264 is formed in the main body 261.

In this embodiment, the supporting element 25 is made of a soft material such as foam, the fixing part 262 and the triggering part 263 are integrally formed with the main body 261, and all of the main body 261, the fixing part 262 and the triggering part 263 are made of a metallic material. Moreover, the fixing part 262 is adhered and fixed on the supporting element 25, and the supporting element 25 is adhered and fixed on the switch circuit board 23.

Please refer to FIG. 3 again. The base plate 21, the illumination module 22, the switch circuit board 23, the metallic elastic element 24, the supporting element 25 and the metallic pressing plate 26 are covered by the covering member 27. In addition, the covering member 27 is exposed outside the key structure 2. In this embodiment, the covering member 27 comprises an upper covering layer 271 and a lower covering layer 272. The upper covering layer 271 is located over the metallic pressing plate 26 to cover the metallic pressing plate 26. Moreover, the upper covering layer 271 has a light-transmissible region 270 corresponding to the opening 264. The lower covering layer 272 is located under the base plate 21 to cover a bottom surface of the base plate 21. After the lower covering layer 272 and the upper covering layer 271 are combined together to form the covering member 27, the above components are covered by the covering member 27.

That is, the base plate 21, the illumination module 22, the switch circuit board 23, the metallic elastic element 24, the supporting element 25 and the metallic pressing plate 26 are covered by the upper covering layer 271 and the lower covering layer 272 from a top side and a bottom side, respectively. Moreover, the region of the key structure 2 to be contacted by the user's finger is the upper covering layer 271. In this embodiment, the profile of the light-transmissible region 270 matches the profile of the corresponding character symbol of the key structure 2. For example, the key structure 2 is the key "P" of the keyboard. The profile of the light-transmissible region 270 matches the profile of the character symbol "P". On the other hand, the profile of the opening 264 corresponding to the light-transmissible region 270 also matches the profile of the character symbol "P". In an embodiment, the light-transmissible region 270 is a hollow structure that is formed by performing a laser-engraving process to remove a portion of the upper covering layer 271 (i.e., the portion of the upper covering layer 271 corresponding to character symbol). The upper covering layer 271 is made of synthetic feather and foam. For example, the synthetic feather is polyurethane (PU) feather. In this embodiment, portion of the upper covering layer 271 corresponding to the main body 261 of the metallic pressing plate 26 is made of the synthetic feather, and the other portion of the upper covering layer 271 is made of foam.

The illumination module 22 comprises a light-emitting element 221, a power-supplying circuit board 222 and a light guide plate 223. The light-emitting element 221 emits the light beam B. The power-supplying circuit board 222 is disposed on the base plate 21. The light-emitting element 221 is supported on the power-supplying circuit board 222. Moreover, the light-emitting element 221 provides electric power to the light-emitting element 221. The light guide plate 223 is arranged between the base plate 21 and the switch circuit board 23. The switch circuit board 23 is used for guiding the light beam B to the opening 264 of the metallic pressing plate 26 through the light guide plate 223. After the light beam B is transmitted through the light guide plate 223, the switch circuit board 23, the opening 264 and the light-transmissible region 270 sequentially, the key structure 2 is illuminated. Moreover, the light guide plate 223 comprises plural light-guiding structures (not shown) corresponding to the opening 264. For example, the light-guiding structures are microstructures or light-guiding dots. After the light beam B is projected on the light-guiding structures, the direction of the light beam B is changed. Consequently, the light beam B is directed to the opening 264.

After the above components are combined together, the assembled key structure 2 is shown in FIG. 4. The operations of the key structure 2 in response to the pressing action of the user will be illustrated as follows. Firstly, the user's finger applies an external force to presses the covering member 27. In response to the external force, the main body 261 of the metallic pressing plate 26 is swung relative to the base plate 21. Consequently, the triggering part 263 of the metallic pressing plate 26 is moved downwardly to push the metallic elastic element 24. Since the metallic elastic element 24 is subjected to deformation to press the switch circuit board 23, the key intersection of the switch circuit board 23 is triggered. Meanwhile, the switch circuit board 23 generates the corresponding key signal. When the user stops pressing the covering member 27, the external force is no longer exerted on the main body 261 of the metallic pressing plate 26. Meanwhile, the metallic elastic element 24 is not pushed by the triggering part 263 of the metallic pressing plate 26. In response to the inherent elasticity, the metallic elastic element 24 is restored to its original shape from the deformation while providing an upward elastic force. In response to the upward elastic force, the main body 261 of the metallic pressing plate 26 is pushed back to its original position where it is not pressed.

Figure 5:
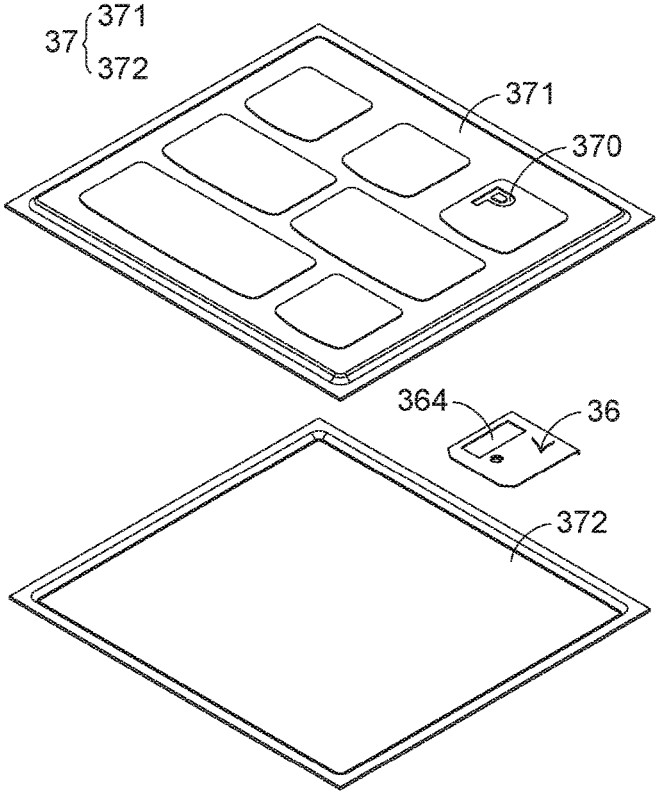
FIG. 5 is a schematic exploded view illustrating a metallic pressing plate and a covering member of a key structure according to another embodiment of the present invention.

The following three aspects should be specially described. Firstly, in some other embodiments, the profile of the opening does not match the shape of the character symbol. FIG. 5 is a schematic exploded view illustrating a metallic pressing plate and a covering member of a key structure according to another embodiment of the present invention. In FIG. 5, the opening 364 of the metallic pressing plate 36 and the covering member 37. The covering member 37 comprises a light-transmissible region 370, an upper covering layer 371 and a lower covering layer 372 are shown. The size of the opening 364 matches the size of the character symbol of the key structure. However, the profile of the opening 364 does not match the profile of the corresponding character symbol of the light-transmissible region 370. As shown in FIG. 5, the profile of the opening is rectangular. The size of the rectangular opening is sufficient to cover the range of the character symbol, or the size of the rectangular opening is slightly larger than the size of the character symbol. It is noted that numerous modifications and alterations may be made while retaining the teachings of the invention. For example, the profile of the opening can be varied according to the practical requirement.

Secondly, in another embodiment, the upper covering layer of the covering member is made of light-transmissible thermoplastic polyurethane (TPU) material. Moreover, the light-transmissible region and an opaque region are formed on the upper covering layer by a local negative printing process. The light beam cannot pass through the opaque region. By the negative printing process, deep color ink or opaque ink is printed on the designated region of the upper covering layer. In an embodiment, the region aligned with the character symbol "P" is the light-transmissible region, and the region not aligned with the character symbol "P" is the opaque region. Consequently, the light beam is only allowed to pass through the region corresponding to the character symbol "P".

Thirdly, the supporting element 25 of the key structure 2 is made of a soft material. When the side of the main body 261 of the metallic pressing plate 26 close to the supporting element 25 is pressed by the user, the main body 261 of the metallic pressing plate 26 is moved downwardly but not swung relative to the base plate 21 because the supporting element 25 is made of the soft material. Since the supporting element 25 is compressed by the main body 261 of the metallic pressing plate 26, the supporting element 25 is subjected to deformation and the triggering part 263 is moved downwardly to push the metallic elastic element 24. That is, the supporting element 25 must be made of the soft material. When any side or any corner of the main body 261 of the metallic pressing plate 26 is pressed by the user, the main body 261 of the metallic pressing plate 26 is swung or moved. Consequently, the triggering part 263 of the metallic pressing plate 26 is moved downwardly to push the metallic elastic element 24. If the supporting element 25 is not made of the soft material, the metallic elastic element 24 is possibly not pushed by the triggering part 263 when any side or any corner of the main body 261 of the metallic pressing plate 26 is pressed by the user. Moreover, the supporting element 25 made of the soft material can provide enhanced tactile feel.

From the above descriptions, the present invention provides a key structure. The key structure of the present invention is equipped with a supporting element and a metallic pressing plate to replace the keycap and the scissors-type connecting element of the conventional key structure. Moreover, the key structure of the present invention is equipped with a metallic elastic element to replace the rubbery elastomer of the conventional key structure. Since the overall thickness of the supporting element and the metallic pressing plate is much smaller than the overall thickness of the keycap and the scissors-type connecting element, the key structure of the present invention is thinner than the conventional key structure. That is, the thickness of the key structure of the present invention is largely reduced when compared with the conventional key structure. Moreover, since the metallic pressing plate of the key structure of the present invention is made of the metallic material, the structural strength of the metallic pressing plate is larger than the conventional key structure that is made of the plastic material. In addition, the metallic pressing plate is not readily damaged. Moreover, the key structure of the present invention further comprises an illumination module under the metallic pressing plate for emitting a light beam. Moreover, the main body of the metallic pressing plate has an opening for allowing the light beam to pass through. Consequently, the key structure has the luminous efficacy.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

an illumination module disposed on the base plate, and emitting a light beam; a switch circuit board disposed on the illumination module, wherein when the switch circuit board is triggered, a key signal is generated;

a metallic elastic element disposed on the switch circuit board, wherein the metallic elastic element is subjected to deformation to trigger the switch circuit board when the metallic elastic element is pressed, or the metallic elastic element provides an elastic force;

a supporting element made of a soft, deformable material and disposed on the switch circuit board, and located beside the metallic elastic element;

a metallic pressing plate, wherein an edge of the metallic pressing plate is fixed on the supporting element, and the supporting element is deformed and the metallic pressing plate is swung relative to the base plate to push the metallic elastic element in response to an external force, wherein the metallic pressing plate has an opening; and a covering member covering the base plate, the illumination module, the switch circuit board, the metallic elastic element, the supporting element and the metallic pressing plate, wherein the covering member has a light-transmissible region corresponding to the opening, wherein the light beam passes through the switch circuit board, the opening and the light-transmissible region sequentially, so that the key structure is illuminated;

wherein the metallic pressing plate further comprises: a main body swingable relative to the base plate; a fixing part located at the edge of the metallic pressing plate and connected with the main body, wherein the fixing part is a bent structure relative to the main body, and the edge of the metallic pressing plate is fixed on the supporting element through the fixing part; and a triggering part disposed on a bottom surface of the main body and contacted with the metallic elastic element.

2. The key structure according to claim 1, wherein the fixing part is adhered and fixed on the supporting element, and the supporting element is adhered and fixed on the switch circuit board.

3. The key structure according to claim 1, wherein the fixing part and the triggering part are integrally formed with the main body, and the main body, the fixing part and the triggering part are made of a metallic material.

4. The key structure according to claim 1, wherein the covering member further comprises:

an upper covering layer located over the metallic pressing plate to cover the metallic pressing plate, wherein the light-transmissible region is formed in the upper covering layer; and a lower covering layer located under the base plate to cover the base plate, wherein the lower covering layer and the upper covering layer are combined together.

5. The key structure according to claim 4, wherein the light-transmissible region is a hollow structure that is formed by performing a laser-engraving process to remove a portion of the upper covering layer, and the upper covering layer is made of synthetic feather and foam, wherein the synthetic feather is polyurethane (PU) feather.

6. The key structure according to claim 4, wherein the upper covering layer is made of light-transmissible thermoplastic polyurethane (TPU) material, and the light-transmissible region and an opaque region are formed on the upper covering layer by a local negative printing process, wherein the light beam is not allowed to pass through the opaque region.

7. The key structure according to claim 1, wherein the illumination module comprises:

a light-emitting element emitting the light beam;

a power-supplying circuit board providing electric power to the light-emitting element; and a light guide plate arranged between the base plate and the switch circuit board, wherein the light beam is guided to the opening of the metallic pressing plate through the switch circuit board by the light guide plate.

8. The key structure according to claim 1, wherein a profile of the opening matches a profile of a character symbol of the key structure.

9. The key structure according to claim 1, wherein when the external force is not exerted on the metallic pressing plate, the metallic elastic element is restored to an original shape from deformation and provides the elastic force to the metallic pressing plate, wherein the metallic pressing plate is restored to an original position in response to the elastic force.

* * * * *